US010864654B2

(12) United States Patent
Yin et al.

(10) Patent No.: US 10,864,654 B2
(45) Date of Patent: Dec. 15, 2020

(54) METHOD OF FORMING A WAFFLE SLAB WITH CONCRETE SURFACES THAT DO NOT REQUIRE POLISHING

(71) Applicant: RUENTEX ENGINEERING & CONSTRUCTION CO., LTD., Taipei (TW)

(72) Inventors: Samuel Yin, Taipei (TW); Jui-Chen Wang, Taipei (TW); Kun-Jung Shu, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 419 days.

(21) Appl. No.: 15/824,304

(22) Filed: Nov. 28, 2017

(65) Prior Publication Data

US 2019/0077044 A1 Mar. 14, 2019

(30) Foreign Application Priority Data

Sep. 8, 2017 (TW) ..... 106130709 A

(51) Int. Cl.
*B28B 1/16* (2006.01)
*B28B 23/00* (2006.01)
(Continued)

(52) U.S. Cl.
CPC ..... *B28B 1/16* (2013.01); *B28B 7/0008* (2013.01); *B28B 7/164* (2013.01); *B28B 7/186* (2013.01);
(Continued)

(58) Field of Classification Search
None
See application file for complete search history.

(56) References Cited

U.S. PATENT DOCUMENTS

2002/0092249 A1* 7/2002 Yin ..... E04B 5/43 52/263
2013/0273319 A1* 10/2013 Chen ..... C04B 41/009 428/142

FOREIGN PATENT DOCUMENTS

CN 101457581 A 6/2009
CN 101806112 A 8/2010
(Continued)

OTHER PUBLICATIONS

Taiwan office action dated Oct. 17, 2018, in counterppart Taiwan appplication TW106130709, and search report, 8 pages in Chinese.
(Continued)

*Primary Examiner* — Monica A Huson
*Assistant Examiner* — Kelsey C Grace
(74) *Attorney, Agent, or Firm* — Juan Carlos A. Marquez; Marquez IP Law Office, PLLC

(57) ABSTRACT

The present disclosure relates to a method of forming a waffle slab with concrete surfaces that do not require polishing, the method comprising: providing steel molds connected to each other, and forming a space in the steel molds, wherein at least one of the steel molds has a hole; disposing a plurality of inner molds in the space formed by the steel molds; disposing predetermined steel bar cages between the plurality of inner molds, and between the plurality of inner molds and the steel molds; disposing a steel plate on top surfaces of the steel molds, wherein the steel plate comprises separate air holes; and pouring a Self-Compacting Concrete (SCC) into the space from the hole of the at least one of the steel molds such that the SCC fills the space to form the waffle slab.

12 Claims, 6 Drawing Sheets

(51) Int. Cl.

| | |
|---|---|
| ***B28B 7/26*** | (2006.01) |
| ***B28B 7/38*** | (2006.01) |
| ***B28B 23/02*** | (2006.01) |
| ***B28B 13/02*** | (2006.01) |
| ***B28B 7/18*** | (2006.01) |
| ***B28B 7/16*** | (2006.01) |
| ***B28B 7/00*** | (2006.01) |

(52) U.S. Cl.
CPC ..... *B28B 7/26* (2013.01); *B28B 7/386* (2013.01); *B28B 13/021* (2013.01); *B28B 23/00* (2013.01); *B28B 23/02* (2013.01)

(56) References Cited

FOREIGN PATENT DOCUMENTS

| | | | |
|---|---|---|---|
| CN | 202530614 | U | 11/2012 |
| CN | 203034320 | U | 7/2013 |
| TW | 8176 | | 4/1971 |
| TW | 450280 | U | 8/2001 |
| TW | 1239324 | | 9/2005 |

OTHER PUBLICATIONS

Chinese Office Action and Search Report dated Mar. 4, 2020, in counterppart Chinese appplication 201710804044.3, 11 pages in Chinese.

* cited by examiner

METHOD OF FORMING A WAFFLE SLAB WITH CONCRETE SURFACES THAT DO NOT REQUIRE POLISHING

FIELD

The invention relates to a method of forming a waffle slab. More specifically, the invention relates to a method of forming a waffle slab with concrete surfaces that do not require polishing.

BACKGROUND

Waffle slabs are widely used in the fields of civil engineering and architectural engineering as floors for withstanding micro vibrations and other purposes. Industrial plants, specifically, high-tech plants such as a wafer foundry ("Fab"), are typically built with waffle slabs as floors for placement of equipment and machines, which requires resistance against microvibrations. Waffle slabs may also be used as the floor of a clean room of a high-tech factory. A clean room is designed to maintain positive pressure such that air with contaminants is exhausted via the holes provided in the waffle slabs. The contaminated air is then filtered and returned into the clean room.

Please refer to FIG. 1, which teaches a conventional method of forming a waffle slab including steps 101 to 108. Step 101 is providing steel molds; step 102 is cleaning the steel molds; step 103 is disposing a plurality of inner molds in the space formed by the steel molds; step 104 is disposing steel bar cages between the plurality of inner molds, and between the plurality of inner molds and the steel molds; step 105 is pouring concrete into the space; step 106 is waiting for initial condensation of the concrete; step 107 is polishing the concrete surface; and step 108 is releasing the steel molds from the concrete surfaces after the final condensation of the concrete. In the conventional method, step 104, in which steel bar cages are disposed between the plurality of inner molds, and between the plurality of inner molds and the steel molds, is performed in the morning; step 105, in which concrete is poured into the space, is performed in the afternoon; step 106, waiting for initial condensation, is performed in the evening; step 107, in which the concrete surface is polished, is performed at night; and step 108, in which the steel molds are released from the concrete surface, is performed the next morning. Typically, it takes about six to eight hours for steps 106 and 107; and since these steps are performed from evening to night, additional labor is required for these steps. The time required for the initial condensation will affect the subsequent step of polishing (step 107). For example, if the initial condensation occurs much earlier than expected or the initial condensation is concentrated at a particular location, instead of uniformly, the laborers will not be available for the polishing step until the expected time, which will thus affect the quality of the concrete surface; if the initial condensation occurs slower than expected, laborers will need to work overtime, which may affect the schedule for the following day. In addition, if it is raining, the polishing step cannot be performed and the completion of the waffle slab will be delayed.

To overcome the above-mentioned disadvantages of the conventional method, a method of forming a waffle slab with concrete surfaces that do not require polishing is needed.

SUMMARY

One aspect of the invention relates to a method of forming a waffle slab with concrete surfaces that do not require polishing. The method comprises the following steps: (a) providing steel molds connected to each other, wherein a space is formed in the steel molds and at least one of the steel molds has a hole; (b) disposing a plurality of inner molds in the space formed by the steel molds; (c) disposing predetermined steel bar cages between the plurality of inner molds, and between the plurality of inner molds and the steel molds; (d) disposing a steel plate on top surfaces of the steel molds, wherein the steel plate comprises separately distributed air holes; and (e) pouring Self-Compacting Concrete (SCC) into the space from the hole of the at least one of the steel molds such that the SCC fills the space to form the waffle slab. Another aspect of the invention relates to a precast waffle slab structure with concrete surfaces that do not require polishing manufactured according to the above-mentioned method.

A further aspect of the invention relates to a method of forming a waffle slab with concrete surfaces that do not require polishing, comprising: (a') providing steel molds connected to each other, wherein a space is formed in the steel molds and at least one of the steel molds has a hole; (b') cleaning the steel molds; (c') disposing a plurality of inner molds in the space formed by the steel molds; (d') disposing predetermined steel bar cages between the plurality of inner molds, and between the plurality of inner molds and the steel molds; (e') pouring concrete into the space until a height of the poured concrete is close to but less than that of the steel molds; and (f') forming a layer of self-leveling cement on a surface of the concrete. A further aspect of the invention relates to a precast waffle slab structure with concrete surfaces that do not require polishing, manufactured according to the above-mentioned method of the further aspect of the invention.

BRIEF DESCRIPTION OF THE DRAWINGS

The foregoing aspects and many of the accompanying advantages of this invention will become more readily appreciated as it becomes better understood by reference to the following detailed description, when taken in conjunction with the accompanying drawings, wherein.

DETAILED DESCRIPTION

The following contents will describe the implementations of the invention in detail with reference to the figures, which comprise various types of embodiments. It should be noted that the contents of the implementations of the subject application are only for exemplifying one specific aspect of the invention and do not limit the scope of the claimed invention.

Figure 2:
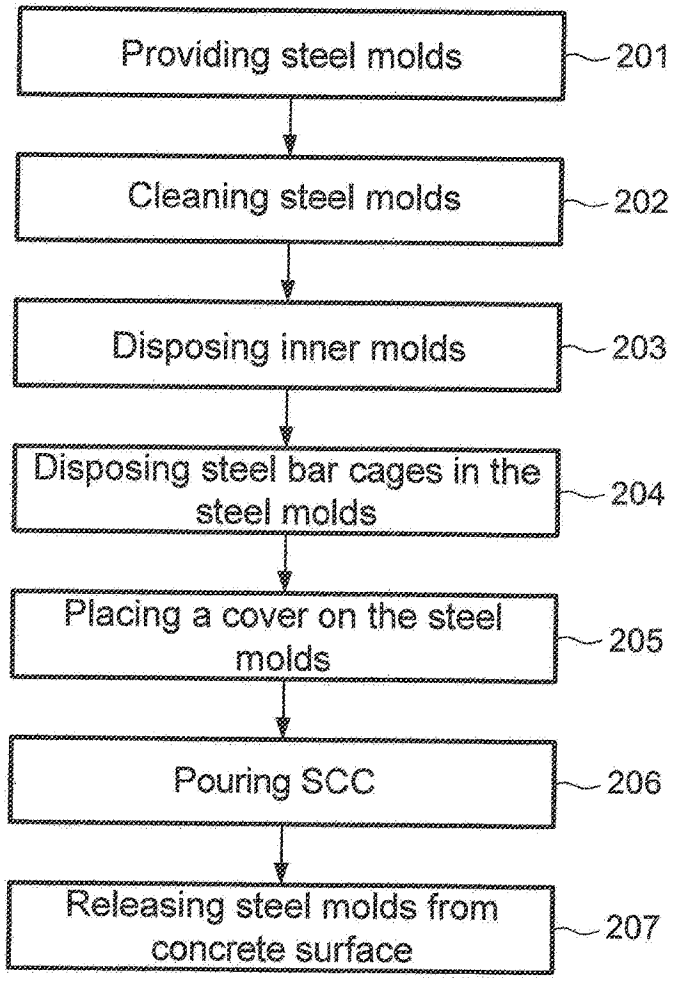
FIG. 2 is a flowchart illustrating a method of forming a waffle slab with concrete surfaces that do not require polishing in accordance with an embodiment of the subject application.
Figure 1:
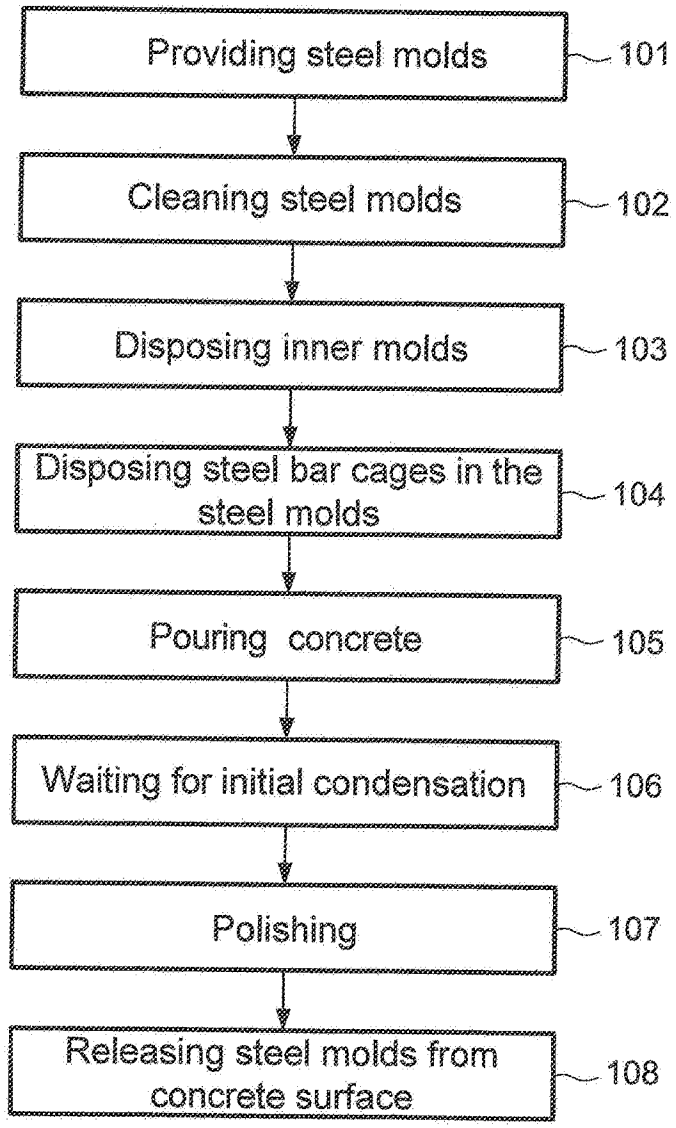
FIG. 1 is a flowchart illustrating a conventional method of forming a waffle slab with concrete surfaces that do not require polishing.

In an embodiment of the subject application, FIG. 2 teaches a method of forming a precast waffle slab with concrete surfaces that do not require polishing in which self-Compacting Concrete (SCC) is used. FIG. 2 is a flowchart illustrating steps 101 to 108 that form such precast waffle slab. Step 201 is providing steel molds; step 202 is cleaning the steel molds; step 203 is disposing a plurality of inner molds in the space formed by the steel molds; step 204 is disposing steel bar cages between the plurality of inner molds, and between the plurality of inner molds and the steel molds; step 205 is placing a cover on top surfaces of the steel molds; step 206 is pouring the Self-Compacting Concrete (SCC) into the space; and step 207 is releasing the steel molds from the concrete surface after the final condensation of the concrete occurs. In one embodiment of the instant application, step 204, disposing steel bar cages between the plurality of inner molds, and between the plurality of inner molds and the steel molds, is performed in the morning; step 205, pouring the SCC into the space, is performed in the afternoon; step 207, releasing the steel molds from the concrete surface, is performed in the next morning. Using SCC for a construction has the following advantages: (1) there is no need to vibrate the concrete and thus labor is reduced; (2) SCC has good flowability and can flow in the narrow pitches between adjacent steel bars to fully fill in each corner of the space; (3) SCC has good water impermeability, resulting in less rust of steel bars in the formed concrete; (4) SCC has high strength and durability after it is formed; (5) SCC does not generate stone pockets of concrete. The method needs no additional labor or overtime, which increases efficiency and reduces costs.

Figure 3:
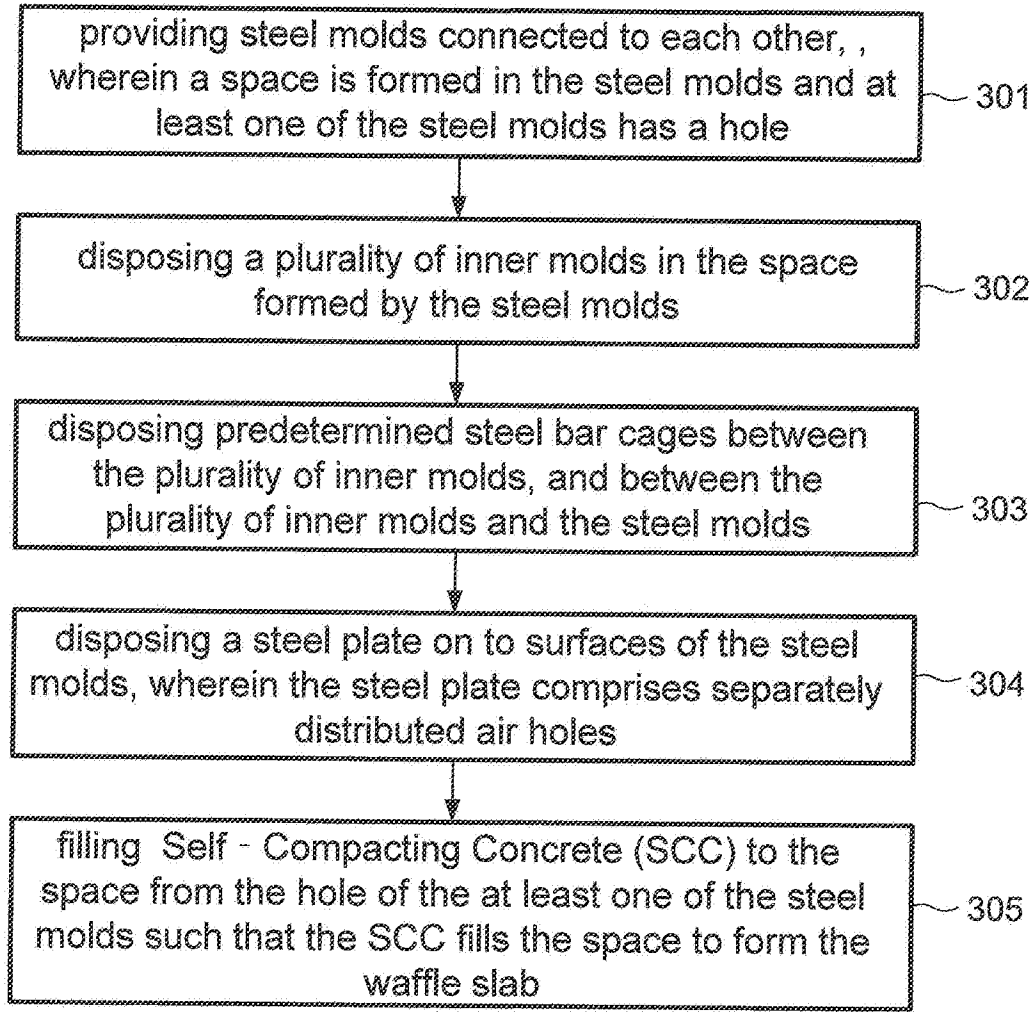
FIG. 3 is a flowchart illustrating a method of forming a waffle slab with concrete surfaces that do not require polishing in accordance with another embodiment of the subject application.

FIG. 3 teaches a method of forming a waffle slab with SCC in accordance with an embodiment of the subject application. FIG. 3 is a flowchart illustrating steps 301-305 for forming a waffle slab with concrete surfaces that do not require polishing. Step 301 is providing steel molds connected to each other, wherein a space is formed in the steel molds, and at least one of the steel molds has a hole, preferably, the steel molds are cleaned before the next step; step 302 is disposing a plurality of inner molds in the space formed by the steel molds; step 303 is disposing predetermined steel bar cages between the plurality of inner molds, and between the plurality of inner molds and the steel molds; step 304 is disposing a steel plate on top surfaces of the steel molds, wherein the steel plate comprises separately distributed air holes; step 305 is filling the space with SCC from the hole of the at least one of the steel molds such that the space is filled with SCC to form the waffle slabs. With a connecting tube connected to the hole, the space is filled with SCC through the connecting tube and the hole. The position of the hole is preferably located at a bottom portion of at least one of the steel molds, and so when SCC is filling in the space from the connecting tube and the hole, the height of the poured SCC gradually increases. The SCC is preferably poured until the height of the SCC is greater than or equal to the height of the steel molds. Alternatively, SCC can be poured until the height of the SCC is equal to the sum of the height of the steel molds and the height of the steel plate. Bubbles generated during the pouring of SCC can be substantively exhausted through the air holes in the steel plate such that the surface of the filled SCC is flat and uniform without or with fewer stone pockets in the concrete surface after the SCC is hardened. The steel molds and the steel plate are removed after the SCC is poured and the strength of the SCC reaches a predetermined strength so as to form a waffle slab with concrete surfaces that do not require polishing.

Figure 4:
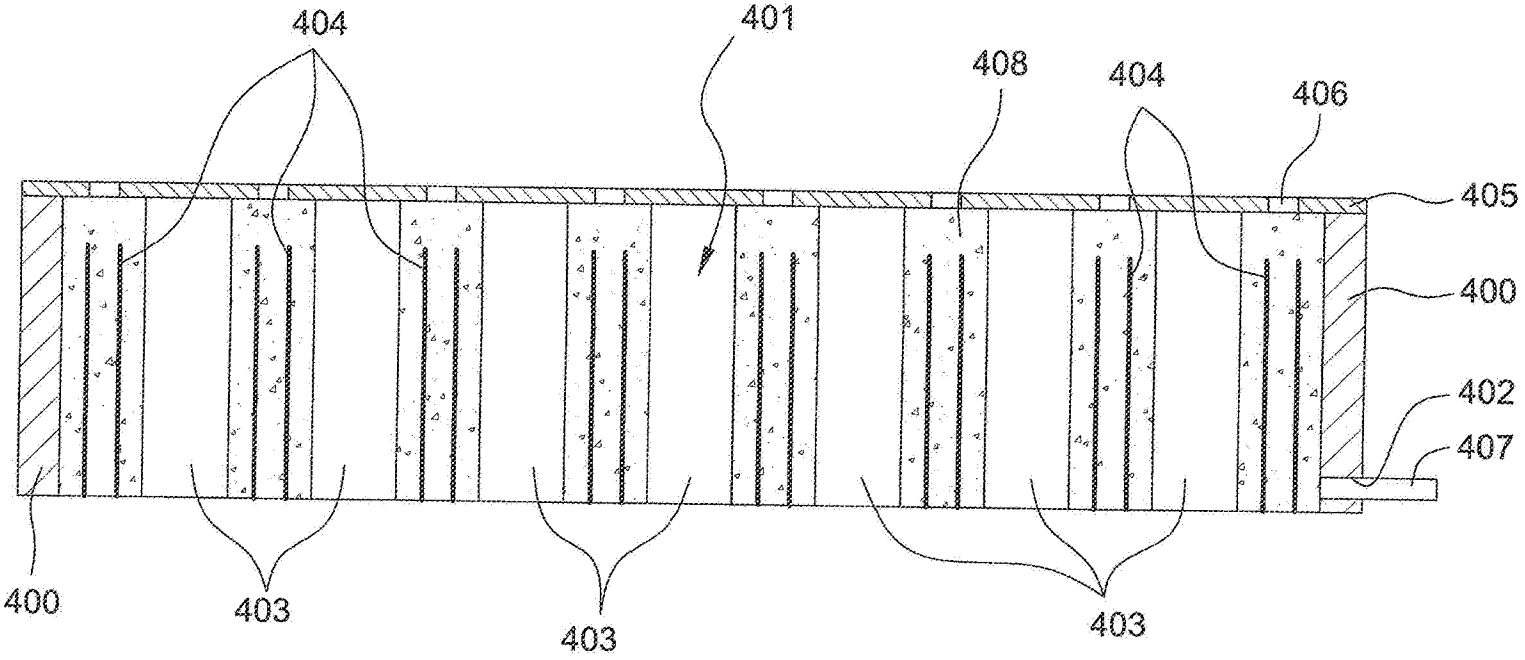
FIG. 4 is a lateral cross-sectional view of the waffle slab made in accordance with the method shown in FIG. 3.

FIG. 4 is a lateral cross-sectional view of the waffle slab made with the method shown in FIG. 3. The steel molds 400 are connected with each other to form a space 401 therein, and at least one of the steel molds 400 has a hole 402. The inner molds 403 are disposed in the space 401 formed by the steel molds 400 for forming through holes in the waffle slab. The predetermined steel bar cages 404 are disposed between the plurality of inner molds 403, and between the plurality of inner molds 403 and the steel molds 400. The steel plate 405 is disposed on top surfaces of the steel molds 400, wherein the steel plate 405 has multiple air holes 406. The air holes 406 are separate from each other and disposed above the predetermined steel bar cages 404. In an embodiment of the subject application, the diameter of the air holes is preferably around 3.75 centimeters. The SCC 408 is poured into the space 401 through the connecting tube 407 engaged with the hole 402 of one of the steel molds 400, such that a waffle slab is formed after solidification of the SCC.

Although bubbles generated during the pouring of SCC into the space 401 formed by the steel plate 405 having air holes 406 and the steel molds 400 can be substantively exhausted through the air holes in the steel plate, some of them still remain in the SCC 408. The area covered by the remaining bubbles is called the bubble area. The size of the bubble area depends on the size and number of air holes 406 in the steel plate 405. Table 1 below shows the experiment results of the bubbles generated according to different sizes and number of air holes 406 in the steel plate 405. Referring to the data shown in the control group in Table 1, when the steel plate 405 has one or more larger air holes, the average percentage of the bubble area is 9% of the area of the steel plate. Referring to the data shown in the test group in Table 1, when the steel plate 405 has multiple uniformly distributed air holes of smaller size, the average percentage of the bubble area is 1.5% of the area of the steel plate. Therefore, the steel plate having uniformly distributed air holes of smaller sizes as shown in Table 1 is preferred.

TABLE 1

| | Specimens | | | | | |
|---|---|---|---|---|---|---|
| | Control group | | | Test group | | |
| | A1 | A2 | A3 | B1 | B2 | B3 |
| | 1 hole-ø60 cm + 54 holes-ø3.75 cm | 1 hole-ø60 cm + 30 holes-ø3.75 cm | 1 hole-ø60 cm | 67 holes-ø3.75 cm | 39 holes-ø3.75 cm | 19 holes-ø3.75 cm |
| | Air hole | | | | | |
| Air hole size | 12.5% Number of air holes | 11.6% Number of air holes | 10.4% Number of air holes | 2.9% Number of air holes | 1.8% Number of air holes | 1.0% Number of air holes |
| 0.4~1.0 | 270 | 254 | 349 | 67 | 41 | 61 |
| 1.0~2.0 | 127 | 117 | 140 | 25 | 8 | 16 |
| 2.0~3.0 | 60 | 35 | 63 | 18 | 6 | 10 |
| 4.0 | 13 | 8 | 16 | 1 | 2 | 4 |
| 5.0 | 7 | 5 | 6 | 2 | 2 | 1 |
| 6.0 | 12 | 1 | 15 | 2 | 1 | 1 |
| 7.0 | 1 | 4 | 6 | 1 | 0 | 2 |
| 8.0 | 2 | 5 | 8 | 0 | 0 | 1 |
| 9.0 | 2 | 1 | 5 | 1 | 1 | 1 |
| 10.0 | 9 | 3 | 19 | 2 | 0 | 2 |
| air hole area | 2236 | 1408 | 3877 | 526 | 216 | 547 |
| ratio of air hole area | 7.99% | 5.03% | 13.85% | 1.88% | 0.77% | 1.95% |
| average ratio of air hole area | | 9.0% | | | 1.5% | |

Figure 5C:
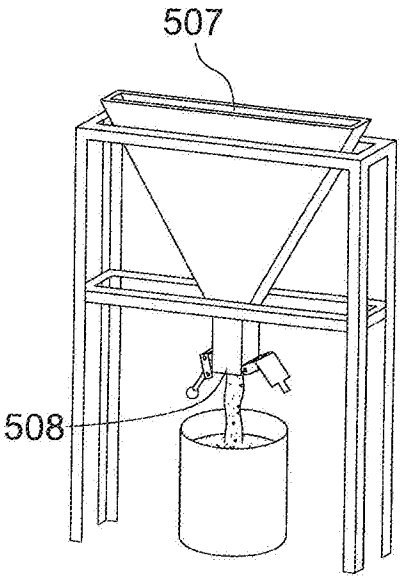
FIG. 5C is a schematic view illustrating a device for the V-shaped funnel test of the SCC used for an embodiment of the subject application.
Figure 5B:
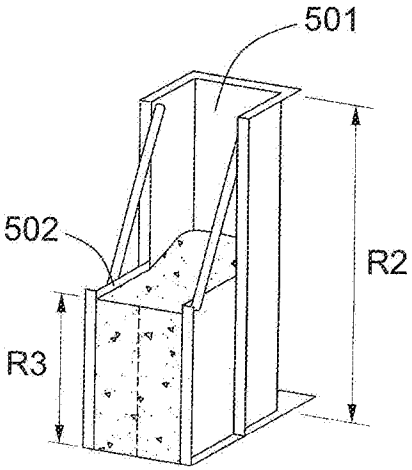
FIG. 5B is a schematic view illustrating a device for the U-shaped filling test of the SCC used for an embodiment of the subject application.
Figure 5A:
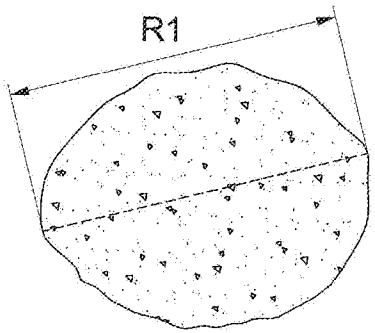
FIG. 5A is a schematic view illustrating a result of the slump test of the SCC used for an embodiment of the subject application.

As shown in FIGS. 5A-5C, there are several tests for evaluating the performance of SCC in the architecture industry. FIG. 5A is a schematic view illustrating a slump test result of a particular type of SCC. In the test, a slump mold is filled with SCC and then swiftly overturned and placed on a level surface with the SCC contained therein. When the slump mold is lifted and the SCC collapses due to its nature and gravity, the vertical height difference between the height of the mold and that of the collapsed SCC is called the "slump." The collapsed SCC forms a shape like a circle. The diameter of the circle "R1" is called "flowability." FIG. 5B is a schematic view illustrating a device for the U-shaped filling test for SCC. The U-shaped groove includes the A groove 501 and the B groove 502. In the test, the A groove 501 is filled with SCC for one minute, then the SCC is allowed to flow from the A groove 501 through steel-bar barriers (not shown) between the A groove 510 and the B groove 502 to fill the B groove 502. The height R2 of the A groove 501 can be twice the height R3 of the B groove 502. If the height of the SCC in the B groove 502 is above 30 centimeters, the SCC is determined to be self-compacting and qualify as SCC. FIG. 5C is a schematic view illustrating the device for the V-shaped funnel test of the SCC. In the test, first the V-shaped groove 507 is filled without shaking for a while, and then the opening at the bottom 508 of the V-shaped groove 507 is opened to let the SCC flow down and the time taken for the SCC to fully flow out of the V-shaped groove 507 is measured.

Table 2 below shows the results of the slump test, U-shaped filling test and V-shaped funnel test for SCC 408 in accordance with an embodiment of the subject application. According to Table 2, the average value of the flowability test for SCC 408 is 64.3 centimeters in diameter; the average value of the U-shaped filling test is 33.3 centimeters; and the average value of the V-shaped funnel test is 16.4 seconds.

TABLE 2

| group | flowability (cm) | U-shaped filling test height (cm) | V-shaped funnel test time (sec) |
|---|---|---|---|
| 1 | 65 | 33.5 | 15 |
| 2 | 65 | 33.5 | 16.8 |
| 3 | 60.5 | 33 | 18.4 |
| 4 | 64.5 | 33.5 | 16.2 |
| 5 | 66 | 33.5 | 17.7 |
| 6 | 65 | 33 | 14.4 |
| average | 64.3 | 33.3 | 16.4 |

Figure 6:
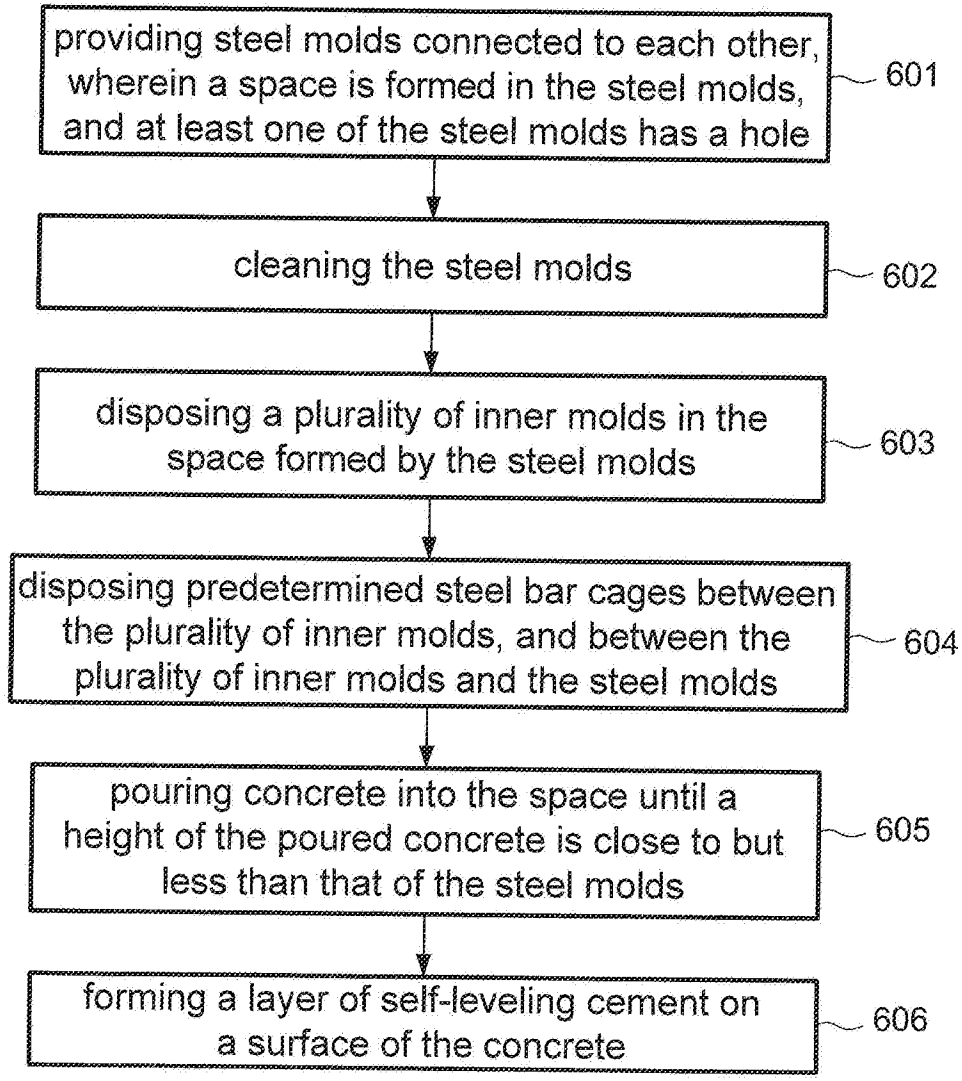
FIG. 6 is a flowchart illustrating a method of forming a waffle slab with concrete surfaces that do not require polishing using self-leveling cement in accordance with an embodiment of the subject application.

FIG. 6 illustrates another embodiment of the subject application for manufacturing a precast waffle slab that does not require polishing using self-leveling cement. FIG. 6 is a flowchart illustrating steps 601-606 for forming such waffle slab. Step 601 is providing steel molds connected to each other, wherein a space is formed in the steel molds and at least one of the steel molds has a hole therein; step 602 is cleaning the steel molds after the step of providing the steel molds connected to each other; step 603 is disposing a plurality of inner molds in the space formed by the steel molds; step 604 is disposing predetermined steel bar cages between the plurality of inner molds, and between the plurality of inner molds and the steel molds; step 605 is pouring concrete into the space until a height of the poured concrete is close to but less than that of the steel molds; step 606 is forming a layer of self-leveling cement on a surface of the concrete to from a waffle slab. In one embodiment, the sum of the height of the self-leveling cement and the height of the concrete generally equals the height of the steel molds. After the step of pouring the self-leveling cement and after the strength of the self-leveling, cement reaches a predetermined strength, the steel molds are removed and then a waffle slab with concrete surfaces that do not require polishing is formed.

Figure 7:
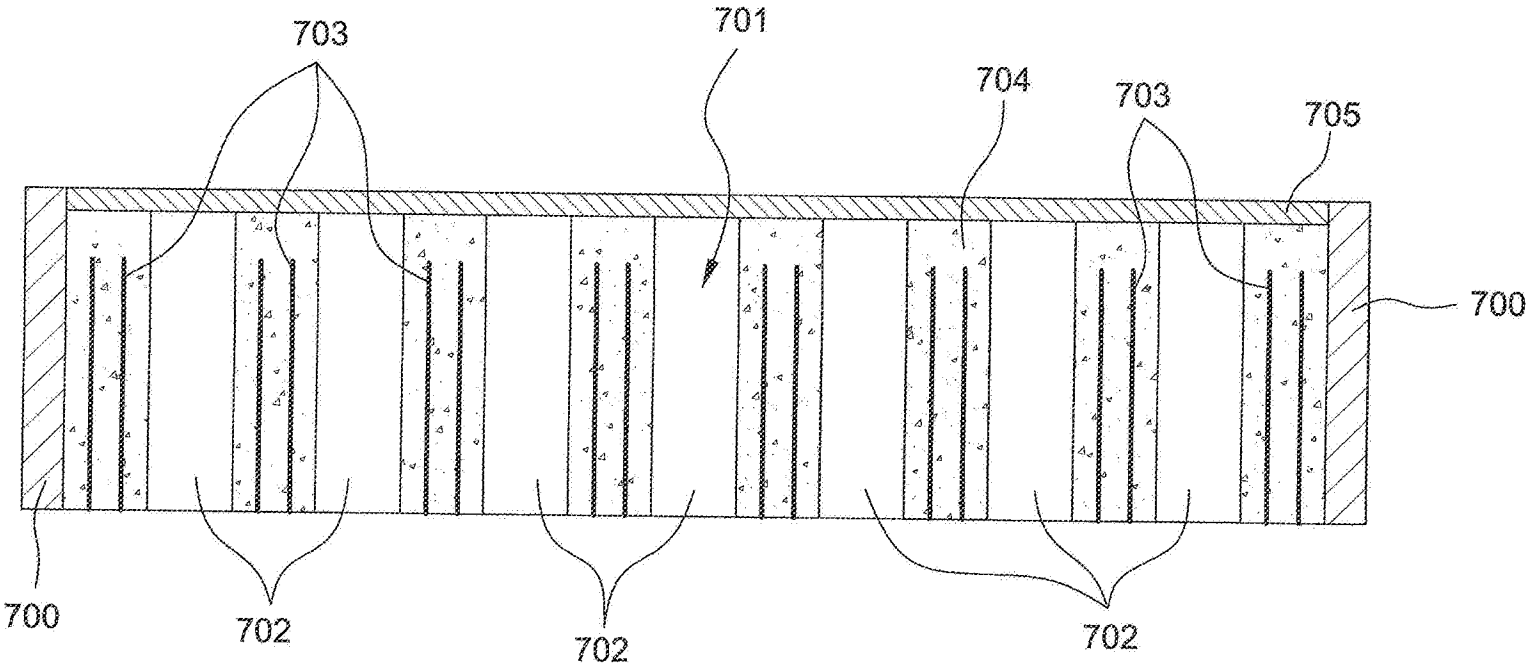
FIG. 7 is a lateral cross-sectional view of the waffle slab with concrete surfaces that do not require polishing in accordance with the method shown in FIG. 6.

FIG. 7 is a lateral cross-sectional view of the waffle slab made in accordance with the method shown in FIG. 6. The steel molds 700 are connected to each other to form a space 701. Inner molds 702 are disposed in the space 701 formed by the steel molds 700 for forming through holes in the waffle slab. Predetermined steel bar cages 703 are disposed between the plurality of inner molds 702, and between the plurality of inner molds 702 and the steel molds 700. Concrete 704 is poured into the space 701 such that the concrete 704 fills in a portion of the space 701. Thereafter, the self-leveling cement 705 is placed onto the concrete 704 such that the sum of the height of the concrete 704 and the height of the self-leveling cement 705 generally equals the height of the steel molds 700. In one embodiment of the subject application, the height of the self-leveling cement 705 ranges from 5 millimeters to 10 millimeters. The self-leveling cement 705 comprises cements, sands, chemical materials, and does not comprise stones.

Furthermore, after a proper amount of water is added to self-leveling cement, it becomes a cement mortar with high fluidity for covering defects in the concrete surface, such as the small holes and gaps on the surface of the cement. Such self-leveling cement can be rapidly solidified to form a flat, smooth and durable floor. In step 606 in FIG. 6, after the self-leveling cement is poured, it becomes flat due to its own gravity, and no additional layer of mortar for polishing is required. Traditionally, significant labor is needed for flattening and polishing concrete surfaces. Where self-leveling cement mortar is used for floor construction, especially in a large area, labor for flattening and polishing can be saved. Additionally, self-leveling cement having high strength and high anti-wear ability is suitable for floors that carry heavy loading, such as industrial plants, outdoor parking lots, shopping malls or natural gas plants.

Although the invention has been illustrated and described with reference to specific embodiments, the illustration and description do not limit the invention. Those of ordinary skill in the art will understand that the invention can be modified and replaced with equivalents without exceeding the true spirit and scope of the invention as claimed. The drawings may be drafted disproportionately. Due to the manufacturing processes and tolerances, differences may exist between the techniques rendered in the invention and actual apparatuses. Other embodiments not specifically illustrated in the subject application can exist. The specification and drawings of the subject application has been made in an illustrative fashion, not a restrictive one. Modifications can be made to adapt specific conditions, materials, compositions, methods or processes to the objective, spirit and scope of the subject application. All types of modifications are intended to be within the scope of the subject application. Although the methods disclosed in the specification are described with reference to specific operations performed in a specific order, it should be understood that equivalent methods can be formed by combining, subdividing or re-ordering these operations without exceeding the disclosure of the invention as claimed. Therefore, unless indicated in the specification, the order and grouping of operations are not limitations of the invention.

The invention claimed is:

1. A method of forming a waffle slab with concrete surfaces that do not require polishing, comprising:

providing steel molds connected to each other, wherein a space is formed in the steel molds and at least one of the steel molds has a hole;

disposing a plurality of inner molds in the space formed by the steel molds;

disposing predetermined steel bar cages between the plurality of inner molds, and between the plurality of inner molds and the steel molds;

disposing a steel plate on top surfaces of the steel molds, wherein the steel plate comprises separately distributed air holes;

filling the space from the hole of the at least one of the steel molds with a Self-Compacting Concrete (SCC);

cleaning the steel molds after the step of providing steel molds connected to each other; and providing a connecting tube connected to the hole, such that the SCC fills in the space through the connecting tube and the hole, and a position of the hole is at the bottom portion of at least one of the steel molds.

2. The method of claim 1, wherein the step of pouring the SCC is pouring the SCC to a height greater than or equal to the height of the steel molds.

3. The method of claim 1, wherein the step of pouring the SCC is pouring the SCC to a height equal to the sum of the height of the steel molds and the height of the steel plate.

4. The method of claim 3, further comprising removing the steel molds and the steel plate after the step of pouring the SCC and after the strength of the SCC reaches a predetermined strength.

5. The method of claim 4, wherein the average value of the U-shaped filling test for the SCC is 33.3 centimeters.

6. The method of claim 4, wherein the average value of the slump test for the SCC is 64.3 centimeters.

7. The method of claim 4, wherein the average value of the V-shaped funnel test for the SCC is 16.4 seconds.

8. The method of claim 4, wherein the diameter of each of the air holes is around 3.75 centimeters.

9. A precast waffle slab structure with concrete surfaces that do not require polishing manufactured according to the method of claim 4.

10. A method of forming a waffle slab with concrete surfaces that do not require polishing, comprising:

providing steel molds connected to each other, wherein a space is formed in the steel molds and at least one of the steel molds has a hole;

cleaning the steel molds;

disposing a plurality of inner molds in the space formed by the steel molds;

disposing predetermined steel bar cages between the plurality of inner molds, and between the plurality of inner molds and the steel molds;

pouring concrete into the space until a height of the poured concrete is close to but less than that of the steel molds; and forming a layer of self-leveling cement on a surface of the concrete;

wherein the step of forming a layer of self-leveling cement on a surface of the concrete is forming a layer of self-leveling cement on a surface of the concrete until the height of the self-leveling cement ranges from 5 millimeters to 10 millimeters.

11. The method of claim 10, wherein the step of forming a layer of self-leveling cement on a surface of the concrete is forming a layer of self-leveling cement on a surface of the concrete until the sum of the height of the self-leveling cement and the height of the concrete generally equals the height of the steel molds.

12. The method of claim 10, wherein the self-leveling cement comprises cements, sands, chemical materials, and does not comprise stones.

* * * * *